United States Patent [19]

Cheng

[11] Patent Number: 5,054,943

[45] Date of Patent: Oct. 8, 1991

[54] RIBBON INKING APPARATUS AND PRINTER CARTRIDGE

[76] Inventor: Wei T. Cheng, 1540 New Haven Rd., Naugatuck, Conn. 06770

[21] Appl. No.: 511,067

[22] Filed: Apr. 19, 1990

[51] Int. Cl.[5] ..... B41J 27/12

[52] U.S. Cl. ..... 400/202.3; 400/202.4

[58] Field of Search ..... 400/197, 199, 200, 201, 400/202, 202.2, 202.3, 202.4, 208; 118/268, 322

[56] References Cited

U.S. PATENT DOCUMENTS

| | | | |
|---|---|---|---|
| 1,826,568 | 10/1931 | Pelton | 400/199 |
| 1,967,729 | 7/1934 | Weis | 400/199 |
| 2,074,969 | 3/1937 | Pelton | 400/199 |
| 2,074,970 | 3/1937 | Pelton | 400/199 |
| 2,074,971 | 3/1937 | Pelton | 400/199 |
| 3,887,727 | 6/1975 | Ploeger, Jr. et al. | 40/202.4 |
| 3,981,387 | 9/1976 | Gottschlich | 400/201 |
| 4,153,378 | 5/1979 | Scherrer et al. | 400/200 |
| 4,279,519 | 7/1981 | Shiurila | 400/202.4 |
| 4,636,097 | 1/1987 | Goubeaux | 400/202.4 |
| 4,707,155 | 11/1987 | Burkhead et al. | 400/199 |

FOREIGN PATENT DOCUMENTS

| | | | |
|---|---|---|---|
| 0073474 | 3/1983 | European Pat. Off. | 400/197 |
| 647100 | 6/1937 | Fed. Rep. of Germany | 400/199 |
| 2557217 | 7/1976 | Fed. Rep. of Germany | 400/197 |
| 0099685 | 6/1983 | Japan | 400/197 |
| 2145974 | 4/1985 | United Kingdom | 400/202 |
| 2145975 | 4/1985 | United Kingdom | 400/197 |

OTHER PUBLICATIONS

"Web-Coating Station", IBM Technical Disclosure Bulletin, vol. 26, No. 1, 6/83, pp. 117-118.

*Primary Examiner*—Eugene H. Eickholt

*Attorney, Agent, or Firm*—St. Onge Steward Johnston & Reens

[57] ABSTRACT

A printer cartridge including a leak resistant ink reservoir, a wicking mechanism and an inking apparatus. The reservoir is for a predetermined quantity of ink and resists leakage by an arrangement of venting and dispensing apertures arranged and provided with barriers. The wicking mechanism combines compressible capillary tubing with an applicator, so that pressure on the applicator squeezes the capillary tubing to provide both pumping and capillary transfer of ink from the reservoir to the applicator. The inking apparatus intermittently presses against the applicator to pick up a film of ink and to provide the pumping action for the wicking mechanism. The inking apparatus includes two belts that receive ink from the applicator and apply it to upper and lower zones of a printer ribbon. The ink is then allowed to diffuse into the central impact zone of the ribbon.

26 Claims, 5 Drawing Sheets

RIBBON INKING APPARATUS AND PRINTER CARTRIDGE

FIELD OF THE INVENTION

The present invention relates to the field of printer ribbon cartridges wherein ink is applied to an endless ribbon.

BACKGROUND OF THE INVENTION

Printer ribbon cartridges for high speed printers are typically used with impact printers such as dot matrix printers, which cause extensive and rapid wear of the ribbon. These cartridges typically have an endless ribbon that is continuously inked. The ink is fed by gravity and capillary action from an inkwell or reservoir containing a hard felt mat through a felt wick to a brush that presses against a roller wheel used to advance the ribbon. The felt mat of these prior art reservoirs is usually a fairly hard and dense woolen mat.

It has been found that such prior art printer cartridges are unsatisfactory in several respects. The first problem with the prior art cartridges is that the ink reservoir has been subject to leakage in shipment, as temperature and pressure changes, or upending of the reservoir, can cause sufficient ink to leak from the reservoir so that it is nearly useless. Where pressure or temperature changes occur, ink may be forced out of the cartridge through the felt wick. The second problem with the prior art cartridges is inconsistent print quality over the life of the cartridge. The print quality of prior art cartridges often begins to deteriorate after as little as several hours of continuous use, and continues deteriorating over the next several hours until the print becomes unreadable. This deterioration in print quality is attributable to wear of the ribbon, which becomes less capable of absorbing and transmitting ink as it wears. In addition, the ink suspended in the felt mat of the prior art reservoirs becomes more and more difficult to extract from the mat as the amount of ink in the reservoir decreases, causing uneven print quality.

Accordingly, it would be desirable to provide a printer cartridge that has a leak resistant reservoir, and that has a consistent print quality throughout its operating life.

OBJECTS OF THE INVENTION

It is an object of the invention to provide an ink reservoir that is leak resistant. It is an object of the invention to accomplish leak resistance by providing a predetermined quantity of ink to the reservoir, which has venting apertures arranged such that the reservoir will not leak regardless of orientation or pressure or temperature changes.

It is an object of the invention to provide a wicking mechanism for transferring ink from the reservoir that is effective to provide an ink feed that will provide consistent print quality over its operating life. It is an object of the invention to provide a wicking mechanism that operates like a pump to provide an effective quantity of ink for the ribbon, regardless of the quantity of ink left in the reservoir.

It is an object of the invention to provide an inking apparatus for receiving ink from an ink reservoir and applying it to a ribbon that minimizes wear of the ribbon. It is an object of the invention that this inking apparatus be able to provide a pumping action for the wicking mechanism. It is an object of the invention that the inking apparatus also serve as a tractor apparatus to advance the ribbon.

It is an object of the invention to provide a printer cartridge that has a substantially longer operating life than heretofore known, with consistent print quality throughout its operating life.

SUMMARY OF THE INVENTION

An ink reservoir in accordance with the invention is adapted to be used with a predetermined quantity of ink. A venting aperture is located in one of the reservoir walls above the level of the predetermined quantity of ink. The venting aperture has a dam wall which extends above the level of ink when the reservoir is oriented so that the venting aperture is located in the lower end of the reservoir. A partition dam extends from a wall opposite the venting aperture. The partition dam surrounds and is spaced apart from the venting aperture dam wall at a distance sufficient to permit air flow therethrough. The partition dam is provided with at least one lateral passage located above the ink level when the reservoir is oriented with the venting aperture located at the low end of the reservoir. The foregoing provides the structure for a leak resistant vent that permits pressure equalization between the reservoir and the ambient atmosphere through the venting aperture.

An ink dispensing aperture may also be provided in the reservoir. This ink dispensing aperture is located in one of the walls above the ink level. The dispensing aperture has a dam wall that extends inwardly into the reservoir sufficiently to be above the ink level when the reservoir is oriented such that the dispensing aperture is located in a lowest portion of the reservoir.

Preferably, a mechanical means to keep the ink in suspension is contained within the reservoir, and may comprise a porous sponge material. The sponge is preferably of a very light density, and preferably is compressible to a compressed volume of less than about thirty percent of its relaxed position volume. Most preferably, the sponge material is compressible to a compressed volume of about ten percent of its relaxed position volume.

In addition, a wicking mechanism including an applicator extending from the reservoir through the dispensing aperture is preferably provided for dispensing ink from the reservoir.

A wicking mechanism for dispensing an ink from an ink reservoir in accordance with the invention comprises an ink permeable capillary tube, and a porous applicator in close contact with at least a portion of the capillary tube.

A wick holder preferably is provided to contain the capillary tube and the applicator and preferably includes a slot extending axially along the wick holder. The capillary tube preferably is a woven glass fiber tube shaped into a loop with two trailing ends which are in contact with the ink in the reservoir. In such case, the applicator is located within and in close contact with the loop, and extends laterally from the loop through the wick holder slot. The applicator preferably comprises wool felt.

The capillary tube is compressible to squeeze ink from the capillary tube to transfer ink to the applicator, and when released, to cause additional ink to flow from the reservoir into the capillary tube. The capillary tube has a hollow interior which is filled with ink and squeezing of the tube forces ink out of the tube through the tube walls and/or an open end of the tube where it is absorbed by the applicator. The squeezing is performed by a surface which intermittently bears against the applicator and causes the applicator to intermittently squeeze the capillary tube. This moving surface preferably comprises an inking apparatus that operates to transfer ink from the applicator to the ribbon and to simultaneously advance the ribbon.

An inking apparatus in accordance with one embodiment of the invention comprises at least one endless belt which intermittently pressed against the applicator to receive the ink and thence to pass the belt against the ribbon material to transfer the ink film to the ribbon material. Means for supporting and driving the belt are provided. Preferably there are two belts in parallel, spaced apart positions, so that ink will be applied only to upper and lower zones of the ribbon, rather than the central character transferring printing zone, so that wear of the printing zone of the ribbon is reduced. In such case, the ink will diffuse from the upper and lower zones to the central zone of the ribbon.

Where there are two belts, they may be supported by pulley wheels with spaced apart annular channels. The wheels are held in a holding means such as a yoke. Also included are means for engagement with a source of torque, so that belts can be activated to receive ink from the applicator and apply ink to and advance the ribbon. Typically this will involve a stem or cavity associated with one of the pulley wheels, that can be linked to a drive shaft of the printer.

The belts are pivotable to intermittently bear against the applicator to cause the applicator to squeeze the capillary tube. Since the torque provided by the printer is usually intermittent, the intermittent torque is used to cause the yoke to pivot towards the applicator. The belts have sufficient resilience to pivot the yoke away from the applicator when torque is not being provided.

A wiper to even the ink film on the belts prior to passing the belts against the ribbon material is also preferably provided.

A printer cartridge in accordance with the invention incorporates the foregoing, and broadly comprises a cartridge case, an endless printer ribbon having a character transferring zone which is contained in the cartridge case, an ink reservoir, an ink wicking mechanism for transferring ink from the ink reservoir, and an inking mechanism having at least one belt for receiving ink from the ink wicking mechanism, applying ink to the ribbon adjacent its character transferring central zone, and advancing the ribbon.

DETAILED DESCRIPTION OF THE INVENTION

Referring now to the FIGURES, the invention in its preferred embodiment is described. In the following description, like numbers in the description and drawings refer to the same elements.

Figure 1:
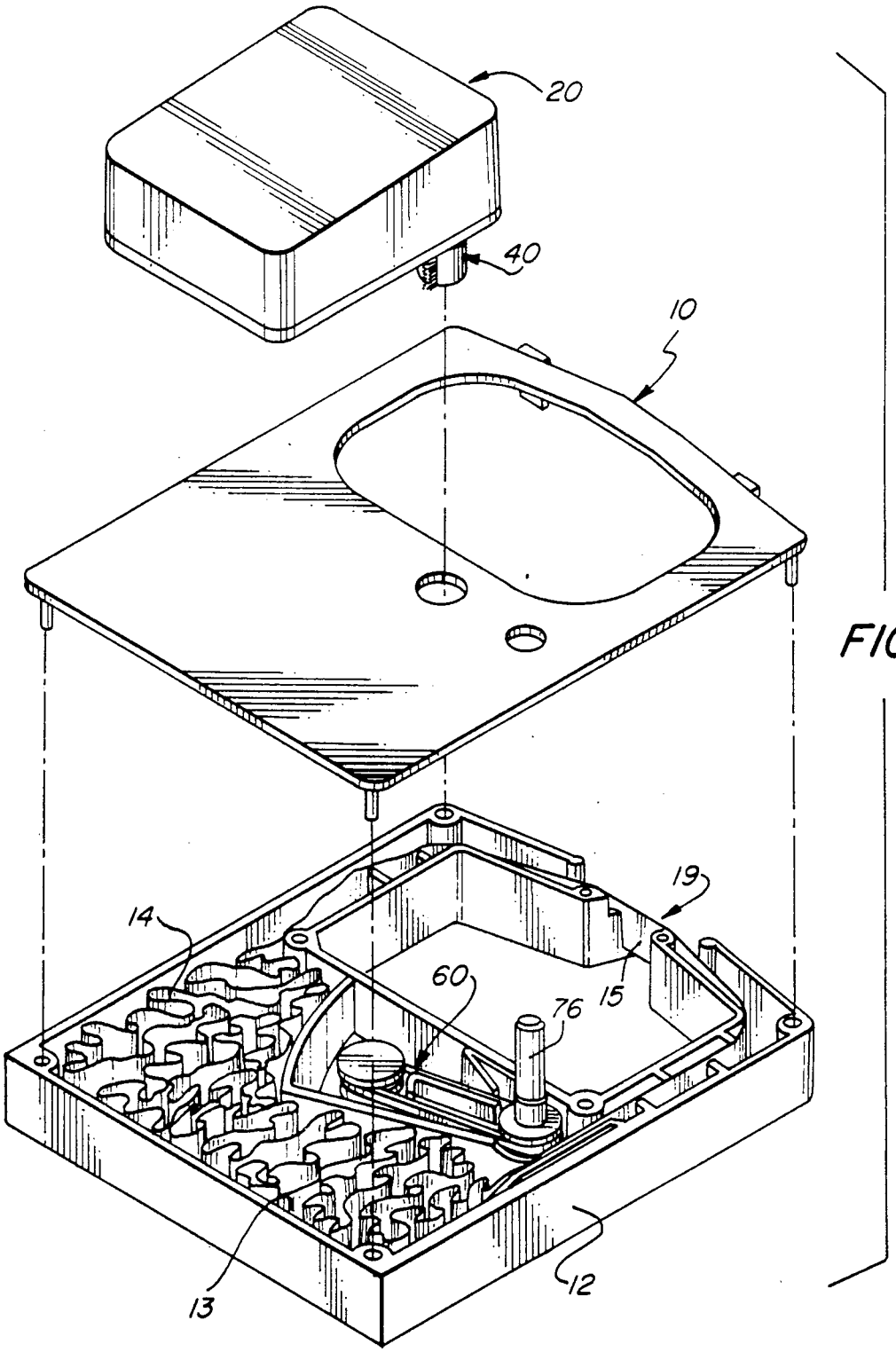
FIG. 1 is an exploded perspective view of a printer cartridge in accordance with the invention.

Referring now to FIG. 1, a printer cartridge is shown generally at 10, and comprises a cartridge case 12, an endless printer ribbon 14 having a character transferring zone 15, an ink reservoir 20, an ink wicking mechanism 40 for transferring ink from the ink reservoir 20, and an inking apparatus 60 having a surface for simultaneously advancing the ribbon 14, receiving ink from the ink wicking mechanism 40 and applying ink to the ribbon 14 adjacent its character transferring central zone 15.

Figure 9:
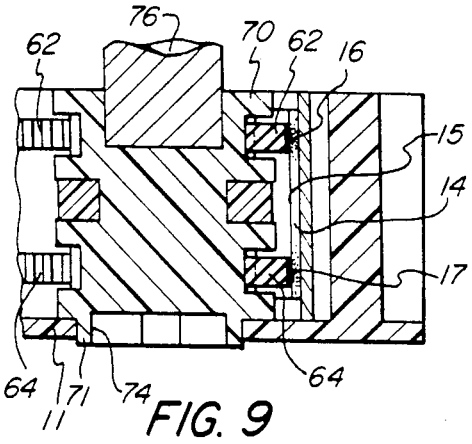
FIG. 9 is a cross-sectional view of one end of the inking apparatus of FIG. 7 shown installed in a cartridge case for applying ink to a ribbon.
Figure 10:
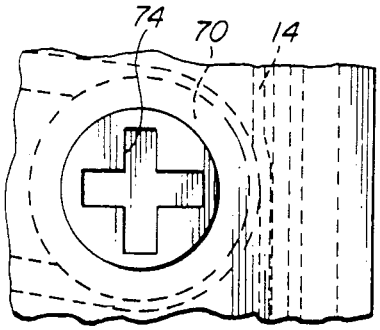
FIG. 10 is a bottom plan view of the end of the inking apparatus shown in FIG. 9.

The cartridge case 12 will be sized and shaped to fit the particular printer to which it is adapted. The ribbon 14 will have a substantial length. Cartridge case 12 is arranged such that a given section of the ribbon 14 is inked by the inking apparatus 60, and then passed to a storage area 13 where the ink, which has been applied to the ribbon 14 in its upper and lower zones 16 and 17, can diffuse to the ribbon central zone 15, all as shown in FIG. 9. The ribbon section then passes through the printing area 19 which is where a print head will impact the ribbon to apply characters to a sheet material such as paper. The ribbon section then returns to the inking apparatus 60. The ribbon 14 is thus continuously inked and used until the ink supply is depleted.

Figure 2:
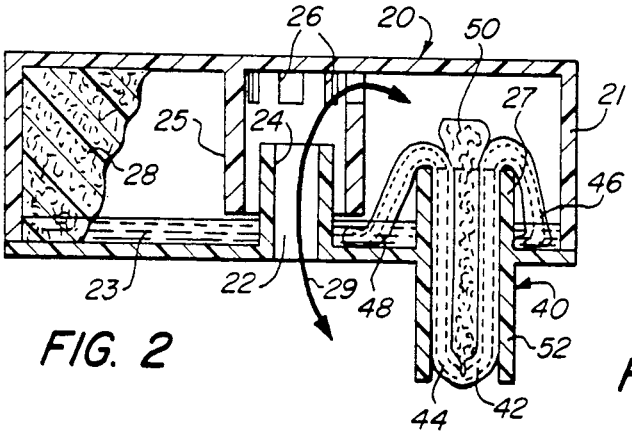
FIG. 2 is a cross-sectional view of an ink reservoir of the present invention with a wicking mechanism installed therein, in its normal upright position.
Figure 4:
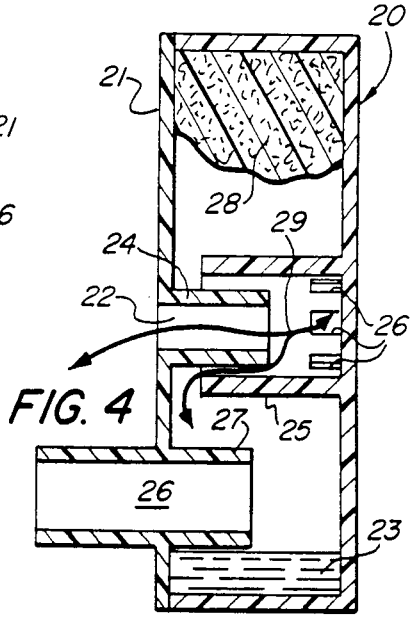
FIG. 4 is a cross-sectional view of the ink reservoir of FIG. 3, in an upended position.
Figure 5:
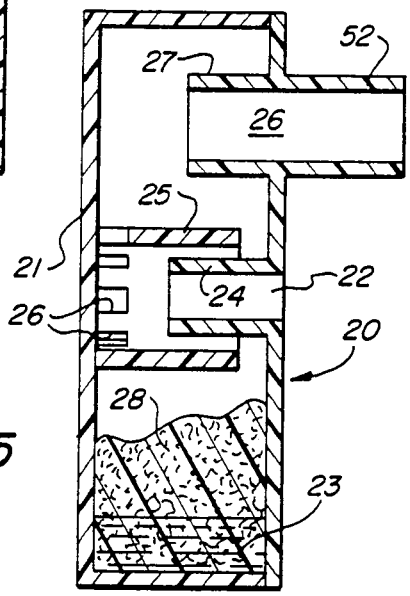
FIG. 5 is a cross-sectional view of the ink reservoir of FIG. 3, in another upended position.

The ink reservoir 20 is shown in FIGS. 2–6. Ink reservoir 20 is designed for a predetermined quantity of ink, and if not overfilled, is highly leak-resistant. Reservoir 20 has walls 21 that form the reservoir case. A venting aperture 22 is located in one of the walls above the level of the predetermined quantity of ink. Thus, as seen in FIGS. 4 and 5, the ink 23 will not drain out of the reservoir 20 through the venting aperture since it is above the level of the ink 23. The venting aperture 22 has a dam wall 24 which extends above the level of ink when the reservoir 20 is oriented as seen in FIG. 2 so that the venting aperture is located in the lower end of the reservoir 20. Thus, as seen in FIG. 2, the ink 23 will not drain out of the reservoir 20 through the venting aperture 22 when so oriented.

A partition dam 25 extends from a wall opposite the venting aperture 22. The partition dam 25 surrounds and is spaced apart from the venting aperture dam wall 24 at a distance sufficient to permit air flow therethrough. The partition dam 25 is provided with at least one lateral passage 26 located above the level of ink 23 when the reservoir is oriented with the venting aperture 22 located at the low end of the reservoir 20, as shown in FIG. 2. Preferably there are a plurality of passages 26 as shown in FIGS. 2–5.

Preferably, the partition dam 25 surrounds the venting aperture dam wall 24 at a distance of about 0.1 to about 0.5 millimeters. Most preferably, the partition dam 25 surrounds the venting aperture dam wall 24 at a distance of about 0.25 millimeters. A substantial axial overlap of the dams 24 and 25 is desirable.

The foregoing arrangement of vent and dams provides a leak resistant vent for air flow regardless or orientation of the reservoir 20, and permits pressure equalization between the reservoir 20 and the ambient atmosphere through the venting aperture 22. Thus leakage that might arise from pressure changes as often occurs in air transport, or temperature changes, is eliminated. In addition, the placement of the overlapping venting aperture dam wall and partition dam prevents leakage through the venting aperture 22 when the reservoir 20 is upended.

An ink dispensing aperture 26 is also preferably provided in the reservoir 20. The ink dispensing aperture 26 is located in one of the walls above the level of ink 23, as seen particularly in FIG. 4. The dispensing aperture 26 also has a dam wall 27 that extends inwardly into the reservoir 20. Dam wall 27 extends above the ink level when the reservoir is oriented such that the dispensing aperture is located in a lowest portion of the reservoir, as seen in FIG. 2.

Figure 3:
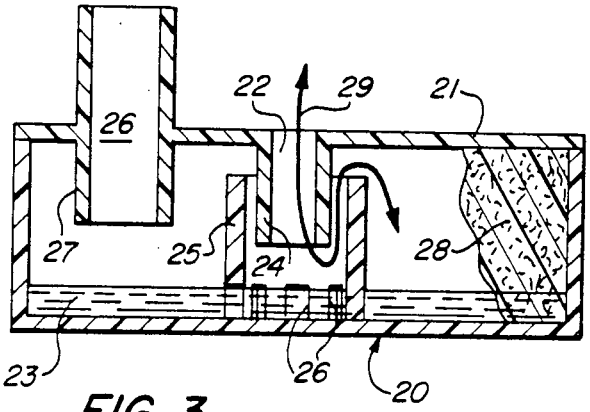
FIG. 3 is a cross-sectional view of an ink reservoir of the present invention without a wicking mechanism installed therein, in an inverted position.

Each of the dam walls 25 and 27, while having a sufficient length to extend above the level of ink 23 when the reservoir is oriented as in FIG. 2, will also be sufficiently short so as to avoid contact with the ink 23 when the reservoir 20 is inverted as shown in FIG. 3. This length is desirable as it reduces the likelihood of leakage if the reservoir is flipped from its inverted to its normal position shown in FIG. 2.

Preferably, the ink dispensing aperture 26 and the venting aperture 22 are located on the same wall of the reservoir 20. Most preferably, they are both located in a lower wall of the reservoir 20 as shown in the normal position of FIG. 2.

As can be seen in FIGS. 2–5, regardless of the orientation of the reservoir, leakage is prevented by the location of the apertures 22 and 26 and the provision of dam walls 24 and 27, respectively. In addition, air flow paths 29 as seen in FIGS. 2, 3 and 4 are maintained regardless of reservoir orientation.

Preferably, a mechanical means to keep the ink in suspension is contained within the reservoir. This mechanical means preferably comprises a porous sponge material 28. The sponge 28 is preferably of a very light density, and preferably is compressible to a compressed volume of less than about thirty percent of its relaxed position volume. Most preferably, the sponge material 28 is compressible to a compressed volume of about ten percent of its relaxed position volume. The sponge material 28 is preferably a polymer foam. The sponge material 28 assists in reducing leakage by limiting ink splash when the reservoir is transported, and also provides for more effective ink wicking by a wicking mechanism as hereafter described.

A method of preventing leakage of a predetermined quantity of ink from a printer cartridge ink reservoir such as reservoir 20 in accordance with the invention comprises venting the reservoir through a venting aperture such as venting aperture 22 located in one of the walls of the reservoir above the level of the predetermined quantity of ink. The venting aperture is separated or walled away from the interior of the reservoir by a dam wall such as dam wall 24 to extend above the level of the predetermined quantity of ink when the reservoir is oriented such that the venting aperture is located in a lowest portion of the reservoir. The venting aperture dam wall is partitioned by a partition dam such as dam 25 which extends from a wall opposite the venting aperture and which surrounds and is spaced apart from the venting aperture dam wall at a distance sufficient to permit air flow through the space to vent the reservoir to the venting aperture. The partition dam is laterally vented above the level of the predetermined quantity of ink when the reservoir is oriented such that the venting aperture is located in a lowest portion of the reservoir.

Figure 6:
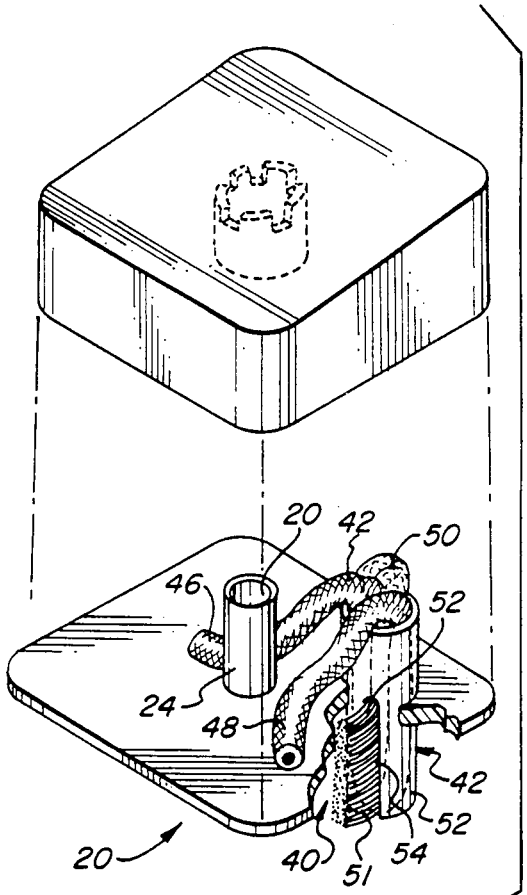
FIG. 6 is an exploded perspective view of an ink reservoir in accordance with the invention with a wicking mechanism installed therein.
Figure 11:
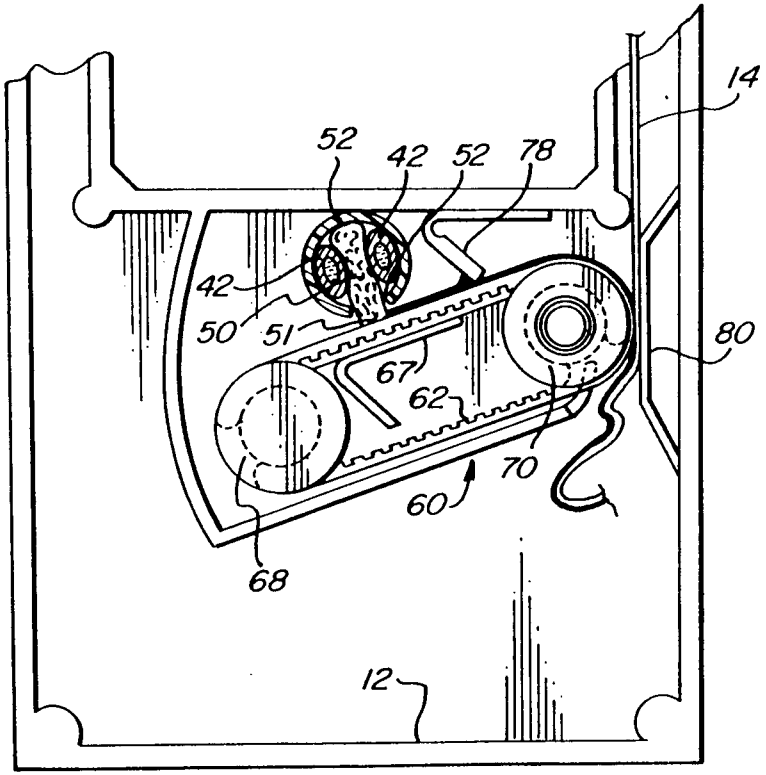
FIG. 11 is a top plan view of an inking apparatus installed in a cartridge, with a cross-sectional view of a wicking mechanism, showing the inking apparatus in a rest position.

A wicking mechanism 40 is shown in FIGS. 2 and 6, and comprises a means for capillary transfer of ink from the reservoir 20, and a porous applicator in close contact with at least a portion of the capillary means to receive ink from the capillary means. Referring now to FIGS. 2, 6 and 11, the capillary means preferably comprises an ink permeable woven glass fiber capillary tube 42. Tube 42 is preferably ink permeable to allow ink transfer from the interior of the tube to the applicator 50 through the rube 42 walls. However, the present invention is also operable if ink is simply transferred through a valved open end of the capillary tube 42. Thus, as used herein, "ink permeable" is intended to encompass both transport paths, however, as already noted, ink transport across the walls of tube 42 is preferable, in order to reliably facilitate the pumping action hereafter described. Tube 42 is preferably shaped into a loop 44 with two trailing ends 46 and 48 which extend into the ink reservoir 20 where they can collect ink. The applicator 50 is preferably located within and in close contact with the loop 44. Applicator 50 preferably extends from inside the reservoir 20, to its extending end 51 and has wicking qualities that serve to transfer ink from the reservoir 20 in addition to the ink transport provided by the capillary tube 42. Applicator 50 preferably comprises wool felt.

Tube 42 and applicator 50 are preferably contained in a wick holder 52. Wick holder 52 extends from reservoir dispensing aperture 26. Wick holder 52 has a dispensing aperture 54 as shown in FIG. 6. Preferably, the wick holder dispensing aperture 54 is a slot extending axially along the free extending end of the wick holder 52. In such case, the capillary tube loop 44 has its loop end located adjacent the free extending end of the wick holder 52. The applicator 50 has its extending end 51 protruding laterally from within the loop 44 through the wick holder dispensing aperture 54.

The capillary tube 42 is compressible to squeeze ink from inside the capillary tube 42 to transfer it to the applicator 50. The ink preferably permeates the walls of tube 42 to reach applicator 50, although ink may also be applied to the applicator through an open end of tube 42. When squeezing of the capillary tube 42 s released, ink flows from the reservoir 20 to the capillary tube 42 by a combination of a pumping action, capillary action, and gravity. The pumping action arises after the squeezed tube 42 is released because the transfer of ink from the tube 42 to applicator 50 creates a partial vacuum in the tube 42, and ink is then drawn from the reservoir 20 through the tube 42 by the pressure differential to fill the tube zone emptied by squeezing. Capillary flow also occurs, since the ink concentration in the squeezed area of the tube 42 is reduced, creating a concentration gradient to induce an ink flow to the squeezed area. Lastly gravity will also have some effect, although in comparison to the foregoing pressure and capillary forces, the gravity induced feed will be of minor effect.

Figure 13:
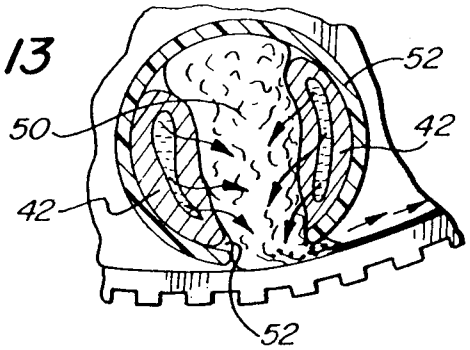
FIG. 13 is a detail view of the wicking mechanism of FIG. 12 showing the flow of ink therethrough.

The squeezing of capillary tube 42 is caused by a moving surface intermittently located and bearing against the applicator 50, as shown in FIG. 13. The moving surface bears against the applicator 50 which in turn squeezes the capillary tube 42. This moving surface preferably comprises an inking apparatus 60 that operates to transfer ink from the applicator 50 to the ribbon 14 and also to advance the ribbon 14.

A method of transferring ink from an ink source to a surface, using a wicking mechanism including an ink permeable capillary tube such as tube 42 connected to an ink source such as reservoir 20, and a porous applicator such as applicator 50, which is in close contact with at least a portion of the tube 42 and which is saturated with the ink, comprises the steps of intermittently causing the surface to press against the applicator by movement of at least one of the wicking mechanism or surface towards the other, such that the ink is transferred from the applicator to the surface and the applicator bears against and squeezes the tube to transfer the ink from the ink source through the tube to the applicator. As hereafter described in reference to inking apparatus 60, the movement of the wicking mechanism or surface preferably comprises pivoting movement of the surface towards the applicator.

An inking apparatus 60 is shown in FIGS. 1, and 7–13, and comprises a surface for receiving a film of ink from the ink film applicator 50 and intermittently pressing against the applicator 50 in a first position, and being movable to a second position for transferring the film of ink to the ribbon 14. More specifically, inking apparatus 60 comprises curved surface such as at least one endless belt, the belt being movable to pass the belt against the applicator 50 to receive a film of ink and thence to pass the belt against the ribbon 14 to transfer the ink film to the ribbon; means for supporting and driving the belt; means for pivoting the belt to intermittently bear against the applicator; and means for engagement with a source of torque, wherein the torque is thereby transmitted to the means for supporting and driving the belt to cause it to move and thereby apply ink to and advance the ribbon, and to pivot the belt to bear against the applicator 50 to receive the ink film. Preferably, wiper means to smooth and reduce the thickness of the ink film are also provided.

Figure 8:
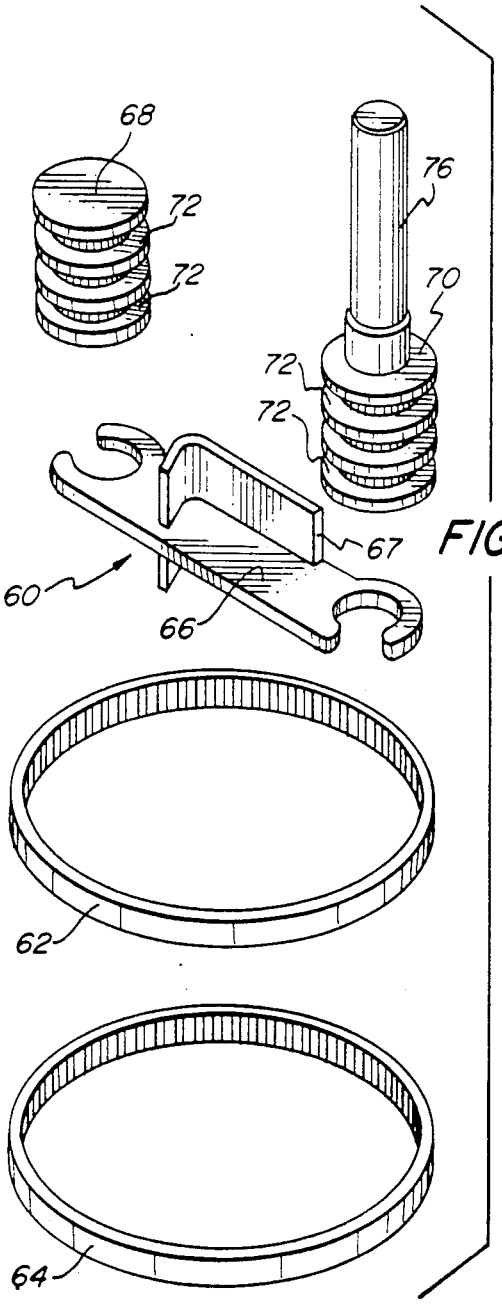
FIG. 8 is an exploded perspective view of an inking apparatus of FIG. 7.
Figure 7:
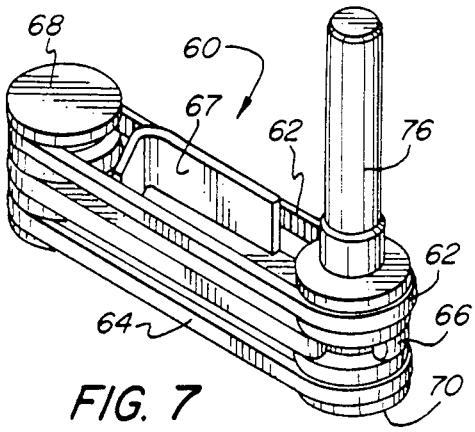
FIG. 7 is a perspective view of an inking apparatus in accordance with the invention.
Figure 12:
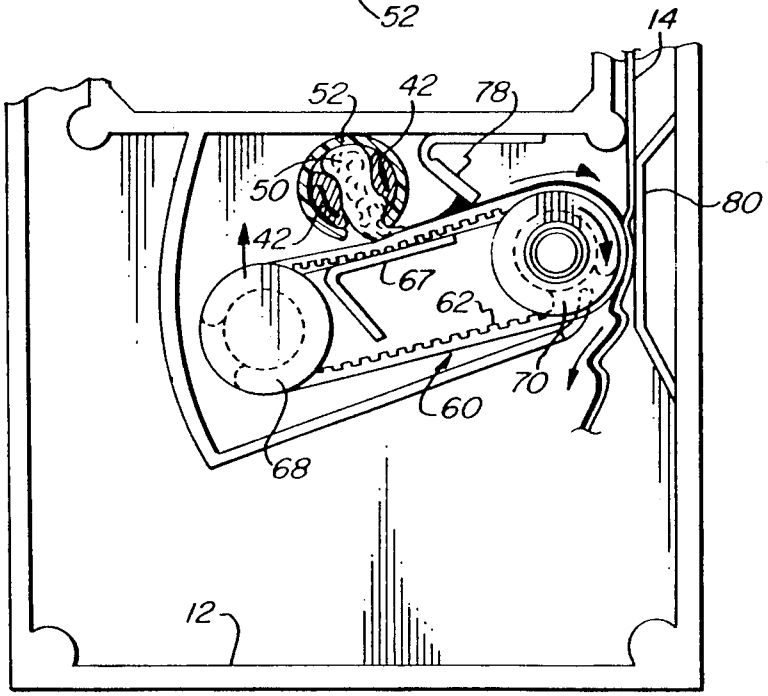
FIG. 12 is the view of FIG. 11, showing the inking apparatus bearing against the wicking mechanism and causing a flow of ink therethrough to the inking apparatus.

Referring now to a preferred embodiment as shown in FIGS. 7–13, there is shown an inking apparatus 60 having two endless belts 62 and 64 for receiving the film of ink from applicator 50 and for transferring the ink to ribbon 14. Belts 62 and 64 are preferably formed of natural or synthetic rubber materials and may be cogged, i.e. having a plurality of regular protrusions, as shown in FIG. 8. It is generally desirable in such case that the smooth side of the cogged belts face outwardly, although the inking apparatus will still operate with the cogs facing outwardly. Belts 62 and 64 are held in parallel, spaced apart positions. Preferably, the holding means is a yoke 66 having pulley wheels 68 and 70 at each end thereof. Yoke 66 preferably includes a retainer wall 67 located where the belts 62 and 64 press against applicator 50, to limit the belts' travel and to permit the belts to be in firm contact with the applicator 50 when torque is applied, as seen in FIG. 12.

Pulley wheels 68 and 70 may be snap fitted or otherwise rotably mounted to the yoke 66. As shown in FIG. 8, the yoke 66 has apertures open at one edge to receive and retain the pulley wheels 68 and 70. Pulley wheels 68 and 70 are provided with annular channels 72 for receiving and holding the belts 62 and 64 in their parallel, spaced apart positions.

The use of two belts is desirable to reduce wear and tear on the central character transferring zone of the ribbon 14. The ink received by the belts 62 and 64 from the applicator 50 is applied to upper and lower zones 16 and 17 of the ribbon 14 only, as seen in FIG. 9, and the ink then permeates to the central zone 15. However, it is to be appreciated that the present invention is not limited to the use of just two belts and that other combinations of moving surfaces may be employed to obtain the desired result, and may for instance include a roller or series of rollers that contact zones other than the character transferring zone of the ribbon.

The inking apparatus 60 is adapted to be engaged by a source of torque, which will be provided by the printer in which the cartridge is mounted. In one embodiment shown in FIGS. 9 and 10, the inking apparatus 60 is provided with a cross-slotted cavity 74 in the base of one pulley wheel 70, which cavity will receive a matching drive shaft when the cartridge is mounted in a printer. Other means for engagement may be provided dependent on the printer design. In addition, a shaft 76 may be provided on one pulley wheel such as wheel 70, to permit the user to manually provide torque to advance ribbon 14 in cartridge 10. The torque provided to the inking apparatus 60 will advance the belts or other surfaces to receive a film of ink from applicator 50 at a first position and to apply ink to the ribbon 14 at a second position.

The inking apparatus 60 is adapted to intermittently press against the applicator 50 to provide the squeezing effect desired to transfer ink from the capillary tube 42-to the applicator 50 and to provide the pumping and capillary action to transfer ink from the reservoir 20 to the capillary tube 42. This intermittent pressure is provided by adapting the inking apparatus 60 to pivot as shown in FIGS. 11 and 12. The pivoting force is provided by the source of torque by way of the means for engagement with the source of torque. Pulley wheel 70 is pivotally mounted to the cartridge, as shown in FIG. 9. This may be accomplished by a snap fit of the lower end 71 of pulley 70 into the cartridge base 11. Pulley wheel 68 is detached from the cartridge and allowed to move within the cartridge. Thus, as can be seen in FIG. 12, when torque is applied to the pulley wheel 70, the inking apparatus 60 pivots about the pulley wheel 70 to press belts 62 and 64 against the applicator 50 to receive a film of ink and cause the applicator 50 to squeeze capillary tube 42 to transfer ink to the applicator 50 from capillary tube 42.

In a high speed printer torque will not continuously be provided to the cartridge 10; torque will be activated and deactivated as the printer program determines whether a given section of ribbon in the printing zone 19 has been subject to a predetermined number of impacts. During the periods when torque is deactivated, the belts 62 and 64 have sufficient resilience to pivot the yoke 66 away from the applicator 50. This permits the release of the squeezing of the capillary tube 42 to induce a flow of ink from the reservoir 20. Accordingly, the belts 62 and 64 will bear only intermittently against the applicator 50.

Wiper means 78 are preferably also provided to even out, smooth and reduce the thickness of the ink film on the belts 62 and 64 prior to passing the belts against the ribbon 14.

Figure 15:
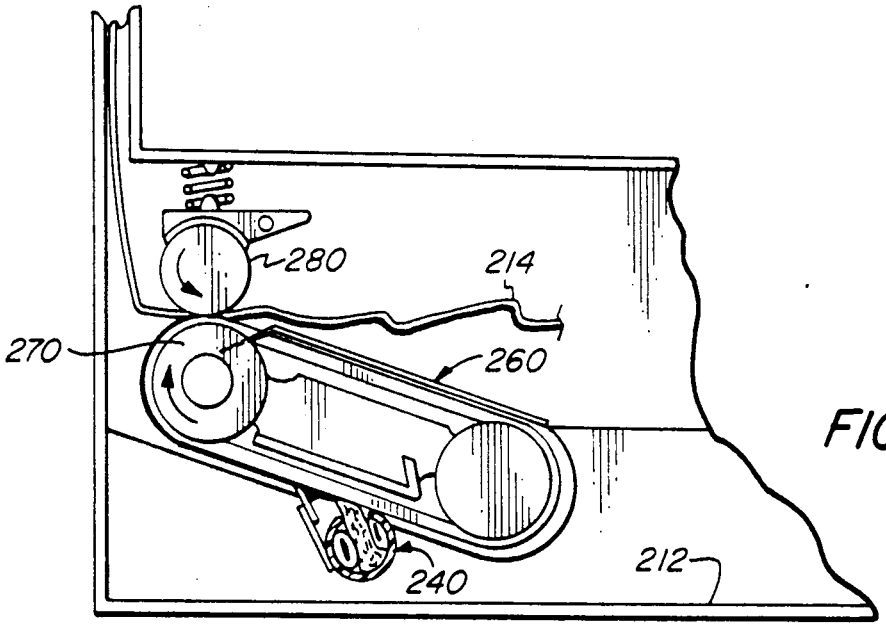
FIG. 15 is a top plan view of another embodiment of an inking apparatus installed in a cartridge, with a cross-sectional view of a wicking mechanism.

An opposing surface is preferably provided to support ribbon 14 where it is contacted by the belts 62 and 64. In FIGS. 11 and 12, the opposing surface is a flexible surface 80 fixed in place opposite from and in contact the pulley wheel 70. In an alternative embodiment shown in FIG. 15, the opposing surface comprises a roller wheel 280 which is spring loaded to bear against ribbon 214 and one pulley wheel 270 of the inking mechanism 260 which is inked by wicking mechanism 240, all of which are substantially as described in reference to the embodiment of FIGS. 7–12.

Figure 14:
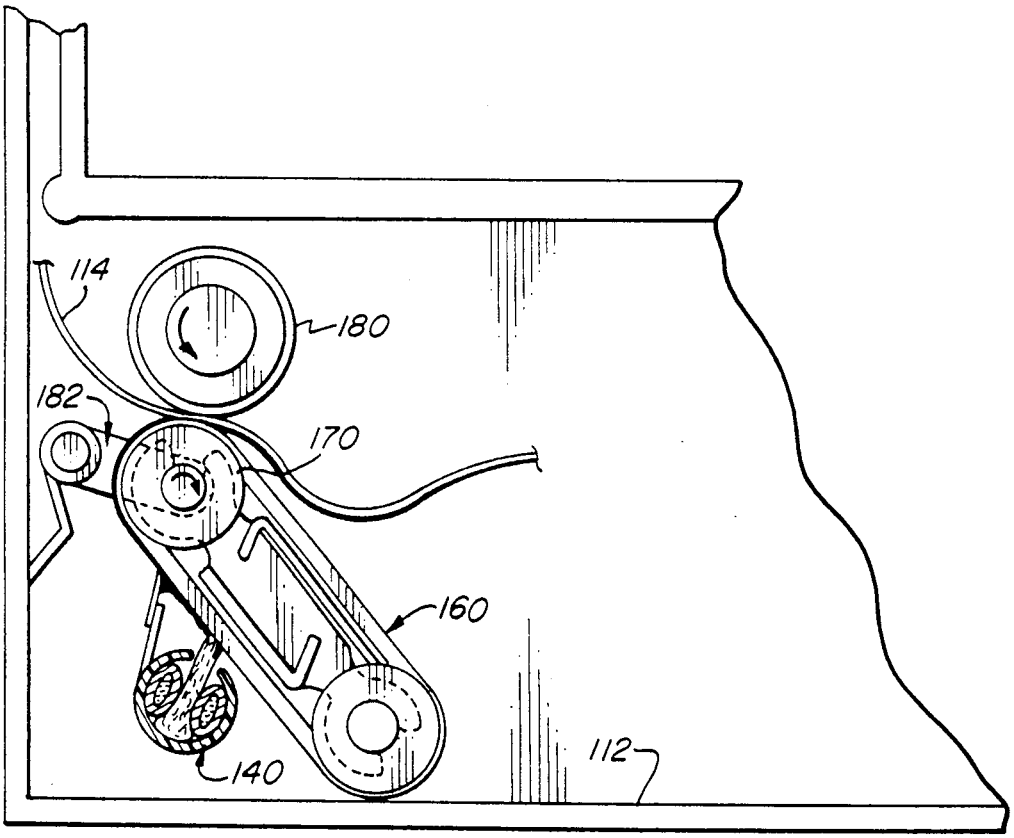
FIG. 14 is a top plan view of another embodiment of an inking apparatus installed in a cartridge, with a cross-sectional view of a wicking mechanism.

In another embodiment of the invention shown in FIG. 14, the source of torque is connected to a roller wheel 180. The inking apparatus 160, which is substantially as described in reference to FIGS. 7–12, is pivotally mounted on a spring loaded arm 182. The moving surfaces of the inking apparatus 160 are inked by a wicking mechanism 140 substantially as previously described, and transfer ink to a ribbon 114 which passes between the inking apparatus 160 and roller wheel 180. In the embodiment shown in FIG. 14, torque provided to the roller wheel 180 will be transmitted to pulley wheel 170 and the belts of the inking apparatus 160, and will cause the other pulley wheel to move toward and bear against the applicator and wiper of the inking apparatus 160.

A method of advancing and applying ink to a ribbon having a- upper zone, a lower zone, and a character transferring middle zone, thus comprises the steps of: locating two parallel spaced apart belts against the upper and lower zones of the ribbon; applying a film of ink to the two belts at a point removed from the ribbon; rotating the belts to move the ink into contact with and to transfer the ink to the upper and lower zones of the ribbon and to advance the ribbon; and diffusing the ink from the upper and lower zones to the character transferring middle zone of the ribbon. The step of applying a film of ink to the belts may comprise causing the belts to intermittently bear against a wicking mechanism to transfer a film of ink from the wicking mechanism to the belts; and causing the belts to move across a wiper means to reduce the thickness of the ink film to a desired ink film thickness. The step of causing the belts to bear against a wicking mechanism may comprise: pivotally retaining one end of the belts in a fixed location; and permitting the other end of the belts to be freely movable in an arc; and transmitting torque to the one end of the belts to cause the other end of the belt to swing toward and bear against the wicking mechanism.

Accordingly, the present invention provides a new and improved ink cartridge that is highly leak resistant, and that will operate to provide a continuous flow of ink until the ink reservoir is exhausted.

I claim:

1. An inking apparatus for applying a film of liquid received from an applicator operably connected to a source of liquid, to a ribbon material, comprising:

at least one endless belt, said belt being movable to pass said belt against the applicator to receive a film of said liquid and thence to pass said belt against the ribbon material to transfer said liquid film to the ribbon material;

means for supporting and driving said belt;

means for pivoting said belt to intermittently bear against the applicator; and means for engagement with a source of torque, wherein said torque is thereby transmitted to said means for supporting and driving said belt to cause it to move and thereby apply liquid to and advance said ribbon, and to pivot said belt to bear against said applicator.

2. An inking apparatus in accordance with claim 1, wherein said ribbon material has an upper zone, a lower zone and a middle zone, and wherein there are two said endless belts, said belts being held in parallel, spaced apart positions, said belts being oriented and located to apply said liquid film only to the upper and lower zones of the ribbon material.

3. An inking apparatus in accordance with claim 2, further comprising:

wiper means to smooth the liquid film on the belts received from the applicator prior to passing said belts against the ribbon material.

4. An inking apparatus in accordance with claim 3, wherein said means for supporting and driving said endless belts comprises:

a yoke having two ends;

a pulley wheel rotably affixed to each end of said yoke, each said wheel being provided with spaced apart annular channels, said endless belts being mounted on and extending around said pulley wheels in said annular channels in parallel, spaced apart positions, said belts being movable by the rotation of at least one said wheel to thereby pass said belts against the applicator to receive a film of the liquid and to pass said belts against the ribbon to apply the liquid film to the ribbon.

5. An inking apparatus in accordance with claim 4, wherein said source of torque is intermittent, and wherein said belts have sufficient resilience to pivot said yoke away from said applicator when torque is not being transmitted to said means for engagement with a source of torque.

6. An inking apparatus in accordance with claim 4, wherein the ribbon is located between one said pulley wheel and an opposing surface to receive the liquid film from the belts, said one pulley wheel being provided at one end with said means for connection to the torque source, said one pulley wheel being provided at its other end with means for pivoting engagement with a workpiece, the other said pulley wheel being detached from said workpiece, said applicator and wiper being located adjacent said yoke between said pulley wheels such that torque provided to the one said pulley wheel will be transmitted through said belts and cause said other pulley wheel to move towards said applicator and wiper such that said belts bear against the applicator.

7. An inking apparatus in accordance with claim 6, wherein said opposing surface comprises a flexible surface fixed in place opposite and in contact with said one pulley wheel.

8. An inking apparatus in accordance with claim 6, wherein said opposing surface comprises a spring loaded roller mechanism adapted to bear against said one pulley wheel.

9. An inking apparatus in accordance with claim 4, wherein said pivoting means comprises a spring loaded arm adapted to retain one of said pulley wheels and to cause said one pulley wheel to bear against the ribbon.

10. An inking apparatus in accordance with claim 9, wherein the ribbon is located between said one pulley wheel and an opposing roller mechanism, said roller mechanism being adapted to be engaged by the source of torque, said one pulley wheel being provided with means for pivoting engagement with said spring loaded arm, said applicator and wiper being located adjacent said yoke between said pulley wheels such that torque provided to the roller mechanism will be transmitted to the one said pulley wheel and belts and cause the other pulley wheel to move towards said applicator and wiper such that said belts bear against the applicator.

11. A printer cartridge, comprising:

a cartridge case;

an endless printer ribbon contained in said cartridge case, said ribbon having a character transferring zone;

an ink reservoir;

an ink wicking mechanism for transferring ink from said ink reservoir; and an ink apparatus having at least one belt, said belt being movable to pass said belt against the wicking mechanism to receive a film of ink and thence to pass said belt against the ribbon material to transfer ink to the ribbon material; means for supporting and driving said belt; means for pivoting said belt to intermittently bear against the wicking mechanism; and means for engagement with a source of torque, wherein said torque is thereby transmitted to said means for supporting and driving said belt to cause it to move and thereby apply ink to and advance said ribbon, and to pivot said belt to intermittently bear against said wicking mechanism.

12. A printer cartridge in accordance with claim 11, wherein said ink reservoir is for a predetermined quantity of ink, and comprises:

reservoir walls;

a venting aperture located in one of said walls above the level of the predetermined quantity of ink, said venting aperture having a dam wall extending above the level of the predetermined quantity of ink when said reservoir is oriented such that said venting aperture is located in a lowest portion of said reservoir;

a partition dam extending from a wall opposite said venting aperture and surrounding and spaced apart from said venting aperture dam wall at a distance therefrom sufficient to permit air flow therethrough to vent said reservoir to said venting aperture, said partition dam being provided with at least one lateral passage therethrough at a location above the level of the predetermined quantity of ink when said reservoir is oriented such that said venting aperture is located in a lowest portion of said reservoir;

a dispensing aperture located above the level of the predetermined quantity of ink in all orientations of said reservoir, said dispensing aperture having a dam wall extending above the level of the predetermined quantity of ink when said reservoir is oriented such that said dispensing aperture is located in a lowest portion of said reservoir; and a porous sponge material filling a substantial portion of said reservoir.

13. A printer cartridge in accordance with claim 11, wherein said ink wicking mechanism comprises:

a wick holder extending from said reservoir and having an aperture therein;

an ink permeable capillary tube extending from said reservoir through said wick holder; and a porous applicator extending from said reservoir and through said wick holder, said applicator being located within and in close contact with said capillary tube, and extending through said wick holder aperture.

14. A printer cartridge in accordance with claim 11, wherein there are two said belts, and said inking apparatus comprises:

a yoke;

a pulley wheel rotably affixed to each end of said yoke, each said wheel being provided with spaced apart annular channels;

said two endless belts being mounted on and extending around said pulley wheels in said annular channels in parallel, spaced apart positions, said belts being movable by the rotation of said wheels to thereby pass said belts against the wicking mechanism to receive a film of ink and to pass said belts against the ribbon to apply the ink film to said ribbon in ribbon zones adjacent the character transferring zone and to advance the ribbon;

means for pivoting said yoke to permit said belts to intermittently bear against the wicking mechanism; and means for engagement with a source of torque, wherein said torque is thereby transmitted to said wheels to both move said belts and to pivot said yoke to cause said belts to bear against said wicking mechanism 15. A printer cartridge, comprising:

a cartridge case;

a printer ribbon contained in said cartridge case, said ribbon having an upper zone, a lower zone, and a character transferring middle zone;

an ink reservoir having a predetermined quantity of ink, reservoir walls, a venting aperture located in one of said walls above the level of the predetermined quantity of ink, said venting aperture having a dam wall extending above the level of the predetermined quantity of ink when said reservoir is oriented such that said venting aperture is located in a lowest portion of said reservoir, a partition dam extending from a wall opposite said venting aperture and surrounding and spaced apart from said venting aperture dam wall at a distance therefrom sufficient to permit air flow therethrough to vent said reservoir to said venting aperture, said partition dam being provided with at least one lateral passage therethrough at a location above the level of the predetermined quantity of ink when said reservoir is oriented such that said venting aperture is located in a lowest portion of said reservoir, a dispensing aperture located above the level of the predetermined quantity of ink in all orientations of said reservoir, said dispensing aperture having a dam wall extending above the level of the predetermined quantity of ink when said reservoir is oriented such that said dispensing aperture is located in a lowest portion of said reservoir and having a wick holder extending outwardly from said reservoir from said dispensing aperture, and a porous sponge material filling a substantial portion of said reservoir;

an ink wicking mechanism for transferring ink from said ink reservoir including a slot extending axially along said wick holder, an ink permeable woven capillary tube forming a loop with two trailing ends, said loop having a loop end located adjacent an end of said wick holder, said trailing ends extending into said reservoir, a porous applicator extending from said reservoir and through said wick holder, said applicator being located within and in close contact with said loop, and extending laterally from said loop through said wick holder slot;

and an inking apparatus, including a yoke, a pulley wheel rotably affixed to each end of said yoke, each said wheel being provided with spaced apart annular channels, one said pulley wheel being provided at one end with means for connection to an intermittent torque source for rotation of said one pulley wheel, said one pulley wheel being provided at its other end with means for pivoting engagement with the cartridge case, the other said pulley wheel being detached from said cartridge case, two endless belts mounted on and extending around said pulley wheels in said annular channels in parallel, spaced apart positions, the ribbon being located between the belts at said one pulley wheel and an opposing surface, said belts being movable by the rotation of said one pulley by the torque source to thereby pass said belts against the applicator to receive a film of ink and to pass said belts against the ribbon to apply the ink film to the ribbon in the upper and lower ribbon zones adjacent the character transferring zone, and to advance the ribbon;

a wiper to smooth the ink film applied by the applicator to said belts, said applicator and wiper being located adjacent said yoke between said pulley wheels such that torque provided to the one said pulley wheel will be transmitted through said belts and cause said other pulley wheel to move towards said applicator and wiper such that said belts bear against the applicator to cause said applicator to bear against said tube to transfer ink from said tube to said applicator, and when torque cease, to pivot said inking apparatus away from said applicator to induce a flow of ink from said reservoir into said tube.

16. An inking apparatus for applying a film of liquid received from an applicator operably connected to a source of liquid, to a ribbon material, comprising:

at least one endless belt;

means for locating said belt to intermittently contact the applicator to thereby receive a film of liquid therefrom; and means for driving said belt to cause it to move and thereby pass said belt against the ribbon material to transfer said liquid film to the ribbon material.

17. An inking apparatus in accordance with claim 16, wherein said ribbon material has an upper zone, a lower zone and a middle zone, and wherein there are two said endless belts, said belts being held in parallel, spaced apart positions, said belts being oriented and located to apply said liquid film only to the upper and lower zones of the ribbon material.

18. An inking apparatus in accordance with claim 16, further comprising:

wiper means to smooth the liquid film on the belt prior to passing said belt against the ribbon material.

19. An inking apparatus in accordance with claim 16, wherein said means for driving said endless belt comprises:

a yoke having two ends;

a pulley wheel rotably affixed to each end of said yoke, each said wheel being provided with an annular channel, said endless belt being mounted on and extending around said pulley wheels in said annular channels, said belt being movable by the rotation of at least one said wheel to cause said belt to bear against the applicator to receive a film of the liquid and to pass said belt against the ribbon to apply the liquid film to the ribbon.

20. An inking apparatus in accordance with claim 16, further comprising means for engagement with an intermittent source of torque, said means for engagement being provided in one said pulley wheel, and said yoke being provided with means for pivoting, whereby said yoke pivots toward and bears against said applicator when torque is being provided by the source of torque.

21. An inking apparatus in accordance with claim 20, wherein the ribbon is located between one said pulley wheel and an opposing surface to receive the liquid film from the belt, said one pulley wheel with said means for engagement with the source of torque having at its other end with means for pivoting engagement with a workpiece, the other said pulley wheel being detached from said workpiece, said applicator and wiper being located adjacent said yoke between said pulley wheels such that torque provided to one said pulley wheel will be transmitted through said belts and cause said other pulley wheel to move towards said applicator and wiper such that said belts bear against the applicator.

22. A printer cartridge, comprising:

a cartridge case;

an endless printer ribbon contained in said cartridge case, said ribbon having a character transferring zone;

an ink reservoir;

an ink wicking mechanism for transferring ink from said ink reservoir; and an inking apparatus having at least one belt, means for locating said belt to intermittently contact the applicator to thereby receive a film of liquid therefrom, and means for driving said belt to cause it to move and thereby pass said belt against the ribbon material to transfer said liquid film to the ribbon material.

23. A printer cartridge in accordance with claim 22, further comprising wiper means to smooth the liquid film on the belt prior to passing said belt against the ribbon material.

24. A printer cartridge in accordance with claim 23, wherein said means for driving said endless belt comprises:

a yoke having two ends;

a pulley wheel rotably affixed to each end of said yoke, each said wheel being provided with an annular channel, said endless belt being mounted on and extending around said pulley wheels in said annular channels, said belt being movable by the rotation of at least one said wheel to cause said belt to bear against the applicator to receive a film of the liquid and to pass said belt against the ribbon to apply the liquid film to the ribbon.

25. A printer cartridge in accordance with claim 24, further comprising means for engagement with an intermittent source of torque, said means for engagement being provided in one said pulley wheel, and said yoke being provided with means for pivoting, whereby said yoke pivots toward and bears against said applicator when torque is being provided by the source of torque.

26. An inking apparatus in accordance with claim 25, wherein the ribbon is located between one said pulley wheel and an opposing surface to receive the liquid film from the belt, said one pulley wheel with said means for engagement with the source of torque being provided at its other end with means for pivoting engagement with a workpiece, the other said pulley wheel being detached from said workpiece, said applicator and wiper being located adjacent said joke between said pulley wheels such that torque provided to one said pulley wheel will be transmitted through said belts and cause said other pulley wheel to move towards said applicator and wiper such that said belts bear against the applicator.

* * * * *